US007270572B2

(12) United States Patent
Rubenstein et al.

(10) Patent No.: US 7,270,572 B2
(45) Date of Patent: Sep. 18, 2007

(54) COMPONENT CONNECTOR

(75) Inventors: Brandon A. Rubenstein, Loveland, CO (US); Robert Blakely, Fort Collins, CO (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 11/089,579

(22) Filed: Jul. 30, 2004

(65) Prior Publication Data

US 2006/0025016 A1 Feb. 2, 2006

(51) Int. Cl.
*H01R 13/648* (2006.01)

(52) U.S. Cl. ..... 439/608; 439/108; 439/607

(58) Field of Classification Search ..... 439/608, 439/607, 887, 108, 101
See application file for complete search history.

(56) References Cited

U.S. PATENT DOCUMENTS

RE32,691 E * 6/1988 Dola et al. ..... 439/608
4,980,245 A * 12/1990 Marino ..... 428/671
5,714,801 A 2/1998 Yano et al.
5,803,768 A * 9/1998 Zell et al. ..... 439/608
6,409,543 B1 * 6/2002 Astbury et al. ..... 439/608
6,428,358 B1 * 8/2002 Figueroa et al. ..... 439/608
6,534,854 B1 3/2003 Fazelpour et al.
6,623,300 B2 9/2003 Sakurai et al.
6,666,719 B1 12/2003 Kuroi et al.
6,709,286 B1 3/2004 Korsunsky et al.
6,877,223 B2 * 4/2005 Figueroa et al. ..... 29/884
6,878,012 B2 * 4/2005 Gutierrez et al. ..... 439/608
6,900,383 B2 * 5/2005 Babb et al. ..... 174/35 MS
2003/0024718 A1 2/2003 Rubenstein et al.

* cited by examiner

*Primary Examiner*—Gary F. Paumen

(57) ABSTRACT

Systems, methodologies, media, and other embodiments associated with connecting a cable to a computer component are described. One exemplary system embodiment includes a component connector comprising at least one signal pin and a plurality of ground pins positioned along a parameter of the at least one signal pin to surround the at least one signal pin. The example system may also include a receptacle connected to and in electrical contact with the plurality of ground pins. The receptacle can be configured with an opening to allow a cable connector to connect to the at least one signal pin.

18 Claims, 4 Drawing Sheets

COMPONENT CONNECTOR

BACKGROUND

Electromagnetic interference (EMI) is a common problem faced during the operation of electronic equipment. EMI is unwanted electromagnetic energy entering or emitting from a piece of electronic equipment, thereby causing interference. EMI can cause that piece of electronic equipment or electronic equipment nearby to function improperly or to not function at all.

Electronic equipment can be housed within a metallic enclosure to help reduce EMI problems. Metallic materials are electrically conductive which serve to block EMI. However, joints or other openings in the enclosure or at cable connection points tend to provide a source of radiation leakage that can cause a reduction in shielding effectiveness.

BRIEF DESCRIPTION OF THE DRAWINGS

The accompanying drawings, which are incorporated in and constitute a part of the specification, illustrate various example systems, methods, and other example embodiments of various aspects of the invention. It will be appreciated that the illustrated element boundaries (e.g., boxes, groups of boxes, or other shapes) in the figures represent one example of the boundaries. One of ordinary skill in the art will appreciate that one element may be designed as multiple elements or that multiple elements may be designed as one element. An element shown as an internal component of another element may be implemented as an external component and vice versa. Furthermore, elements may not be drawn to scale.

DETAILED DESCRIPTION

Figure 1:
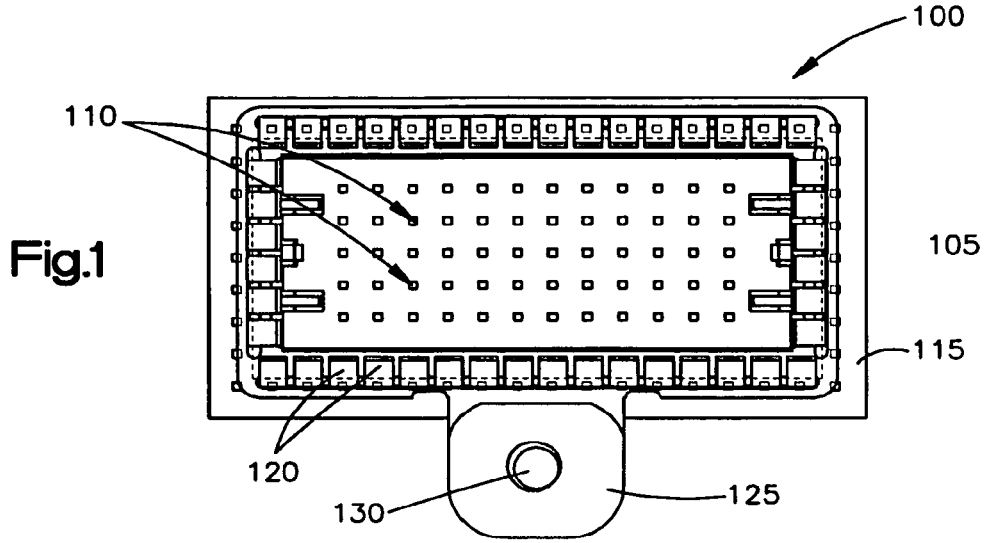
FIG. 1 illustrates an example component connector from a cable connection side.

In one example, a component connector is provided that is configured to allow a cable to connect to a computer component. By connecting a cable to the component connector, communication signals can be transmitted between the computer component and another computer component over the cable. The component connector can be configured to reduce or suppress electromagnetic interference (EMI) that can be caused by electrical fields produced by high-speed signals transmitted through the component connector.

The component connector can also be configured to accommodate a varying range of pin lengths.

The following includes definitions of selected terms employed herein. The definitions include various examples and/or forms of components that fall within the scope of a term and that may be used for implementation. The examples are not intended to be limiting. Both singular and plural forms of terms may be within the definitions.

As used in this application, the term "computer component" refers to a computer-related entity, either hardware, firmware, software, a combination thereof, or software in execution. For example, a computer component can include, but is not limited to, a computer, a housing or enclosure, a circuit board, a processor or other logic device, a peripheral device, and the like.

A "component connector" as used herein, includes but is not limited to the portion of a mating connector pair that is fixedly mounted on an electrical/computer component such as a circuit board.

A "cable connector" as used herein, includes but is not limited to the portion of a mating connector pair that is fixedly mounted at the end of an electrical cable.

"Logic", as used herein, includes but is not limited to hardware, firmware, software and/or combinations of each to perform a function(s) or an action(s), and/or to cause a function or action from another logic, method, and/or system. For example, based on a desired application or needs, logic may include a software controlled microprocessor, discrete logic like an application specific integrated circuit (ASIC), an analog circuit, a digital circuit, a programmed logic device, a memory device containing instructions, or the like. Logic may include one or more gates, combinations of gates, other circuit components, and/or a circuit board of components. Where multiple logical logics are described, it may be possible to incorporate the multiple logical logics into one physical logic. Similarly, where a single logical logic is described, it may be possible to distribute that single logical logic between multiple physical logics.

An "operable connection", or a connection by which entities are "operably connected", is one in which signals, physical communications, and/or logical communications may be sent and/or received. Typically, an operable connection includes a physical interface, an electrical interface, and/or a data interface, but it is to be noted that an operable connection may include differing combinations of these or other types of connections sufficient to allow operable control. For example, two entities can be operably connected by being able to communicate signals to each other directly or through one or more intermediate entities like a processor, a cable, signal lines, an operating system, a logic, software, or other entity. Logical and/or physical communication channels can be used to create an operable connection.

"Signal", as used herein, includes but is not limited to one or more electrical or optical signals, analog or digital signals, data, one or more computer or processor instructions, messages, a bit or bit stream, or other means that can be received, transmitted and/or detected.

FIG. 1 illustrates an example component connector 100 configured to electrically connect a cable to a computer component. In the following examples, the example computer component will be described as a circuit board 105 onto which the component connector 100 is operably mounted. Of course, other types of computer components can be configured with the component connector 100. It will also be appreciated that a cable that can be connected to the component connector 100 includes a cable connector that is configured to mate with the component connector 100. One example of a cable and cable connector will be described with reference to FIG. 4.

The component connector 100 is configured to provide signal return grounding to reduce electromagnetic interference that may be caused by high-speed signals transmitted through the component connector or generated by adjacent electrical components. In one example, the component connector 100 includes one or more signal pins 110 that are electrically connected to and project from the circuit board 105. The signal pins 110 are configured to communicate signals (e.g. receive and/or transmit signals) to electrical contacts in a connected cable. The signal pins 110 can be grouped within an area. Although the illustrated example shows the signal pins 110 grouped in a rectangular area, other pin configurations can be used such as square, triangular, circular, irregular, and the like.

The component connector 100 can also include a receptacle 115 that encloses the signal pins 110 and defines an opening to allow a cable connector to connect to the signal pins 110. The receptacle 115 is connected to and in electrical contact with a plurality of ground pins (not shown in FIG. 1) that extend out from the circuit board 105. In one example, the ground pins follow the contour of the receptacle 115 and are positioned along a perimeter of the signal pins 110 to surround the signal pins 110.

Figure 2:
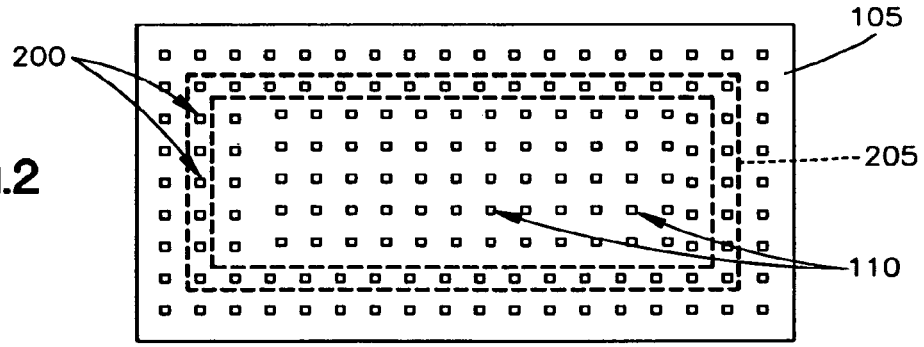
FIG. 2 illustrates an example pin layout that can be used with the example connector shown in FIG. 1.

With reference to FIG. 2, an example pin layout is shown that corresponds to FIG. 1 but with the receptacle 115 removed. A group of ground pins 200 are shown within the dashed rectangular area 205. The group of ground pins 200 are distributed around all sides of the area in which the signal pins 110 are grouped. This provides, for example, a grounding enclosure for the signal pins 110. Once the receptacle 115 is connected to the ground pins 200, the signal pins 110 are further electrically enclosed. For example, the receptacle 115 can be formed of an electrically conductive material that, when in contact with the ground pins 200, is grounded and thus extends an electrical grounding path from the circuit board to the receptacle 115. When the receptacle 115 becomes connected to and in contact with a metal or otherwise electrically conductive cable connector, the cable connector also becomes grounded. Thus, the electrically conductive enclosure of the component connector 100 can provide for signal return grounding and suppression of electromagnetic interference.

Figure 3:
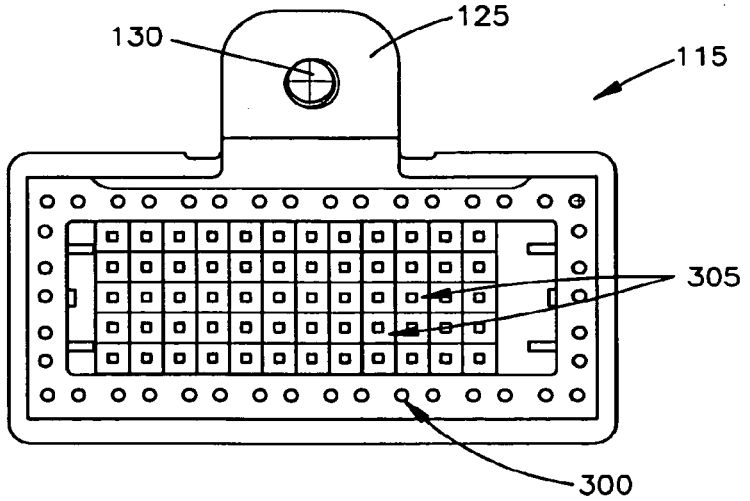
FIG. 3 illustrates a circuit board side bottom view of the example connector shown in FIG. 1.

Illustrated in FIG. 3 is an example footprint configuration of the receptacle 115. The illustrated view shows the receptacle 115 from the circuit board side, meaning, the side that is adjacent to the circuit board. As previously described, the group of ground pins 200 (shown in FIG. 2) extend out from the circuit board and around the perimeter of the signal pins 110. To connect to the ground pins 200, the receptacle 115 includes a plurality of holes or openings 300 that are formed to generally correspond to the positions of the ground pins 200. As an option, the receptacle 115 can include an alignment matrix 305 of internal passages to provide alignment and/or stability to the signal pins 110. Upon mounting the receptacle 115 to the circuit board 105, the signal pins 110 would pass through matrix 305.

In one example, the receptacle 115 can be formed from a metal or a metal alloy and the plurality of holes 300 can be formed by drilling into the receptacle 115, can be formed as part of the design of the receptacle 115, or formed by another desired operation. The receptacle 115 can be formed of an electrically conductive material that is softer than the electrically conductive material forming the ground pins 200. In other words, the receptacle 115 can be formed of a malleable material relative to the ground pins 200 that causes the holes 300 to be compliant. In another example, the holes 300 can be sized smaller than a size of the ground pins 200. In this manner, the receptacle 115 can be press-fitted into contact with the ground pins 200 causing the holes 300 to be deformed under the insertion force of a ground pin.

One example of a deformation can be that a hole 300, with a circular cross-section, can be deformed to have a more square-like cross-section upon the insertion of a square ground pin. Another example can include inserting a circular ground pin into a smaller circular hole that causes the hole to expand to accommodate the ground pin. Thus, the holes 300 can be regarded as compliant holes that adapt to the shape of an inserted pin. Of course, other combinations of pin and hole shapes can be used.

In general, the ground pins 200 can be formed to create an interference fit against the side walls of the holes 300 of the receptacle 115. Having the ground pins 200 in contact with the receptacle 115 creates a grounding electrical path from the ground pins 200 to the electrically conductive receptacle 115. In another example, the holes 300 may be defined in an offset position relative to the ground pins 200 (e.g. a center axis of a hole is offset from a center axis of a corresponding pin). The holes 300 can then have a larger size to more easily accommodate the ground pins 200 with less force. However, the offset positioning can be configured such that one or more sides of the ground pins 200 contact the sides of the corresponding hole 300 to create the electrical contact between the ground pins 200 and the receptacle 115. In another example, which may be combined with previous examples, the holes 300 can be configured to accommodate a variety of pin lengths and sizes. Since the ground pins 300 are in contact with the sides of the holes 300, the holes 300 can be defined with longer depths and will still create the desired electrical contact regardless of whether the ground pins 300 are longer or shorter in length.

It will be appreciated that the receptacle 115 and the ground pins 200 may be formed from a variety of electrically conductive materials. For example, the ground pins 200 can be formed using tin and/or a tin alloy and the receptacle 115 may be formed of brass and/or a brass alloy. The receptacle 115 may also be made of a metal with a conductive oxide layer that is galvanically compatible with the ground pins 200 and is compliant. Brass is an example of such metal. As previously described, the receptacle 115 can be made from a material that is softer than the ground pins 200, which causes the openings 300 of the receptacle 115 to deform or otherwise give way upon the insertion of a ground pin 200.

With reference again to FIG. 1, the receptacle 115 may include other optional components. For example, a gasket 120 can be positioned around the perimeter of the receptacle 115 to provide sealing contact with a connected cable connector. The gasket 120 can be formed of an electrically conductive material that creates an electrical path between the walls of the receptacle 115 and the cable connector. In the illustrated example, the gasket 120 is configured as metallic spring-like contacts. Of course, other configurations of gaskets can be used such as a single component of resilient material that is electrically conductive. A cross-section view of the example gasket 120 can be seen with reference to FIG. 5.

The receptacle 115 can also include a mounting base 125 that can provide further securement of the receptacle 115 to the circuit board 105 and/or to a connected cable. The mounting base 125 can include a threaded opening 130 into which a threaded device like a screw can be used to secure the mounting portion 125 to the circuit board 105 and a connected cable.

Figure 4:
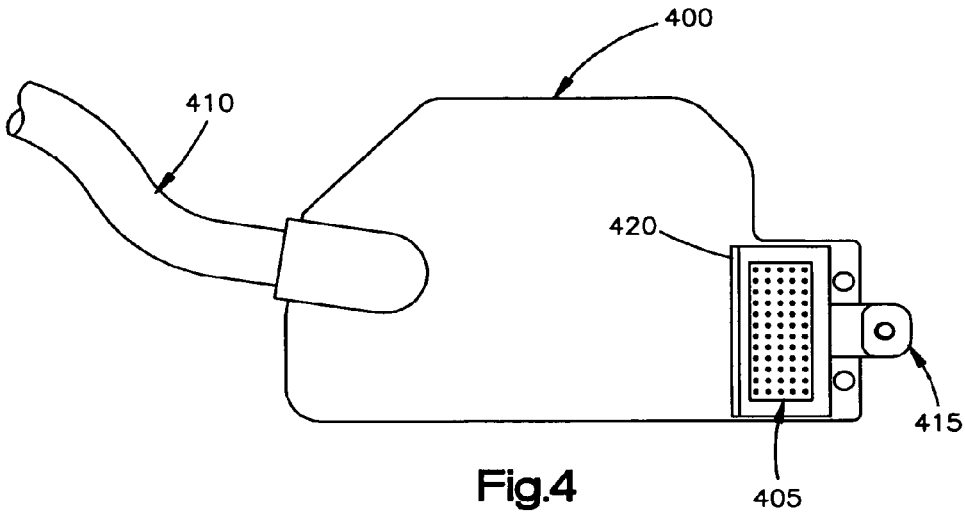
FIG. 4 illustrates an example cable, cable housing and cable connector housing that can be connected to the example connector of FIG. 1.
Figure 5:
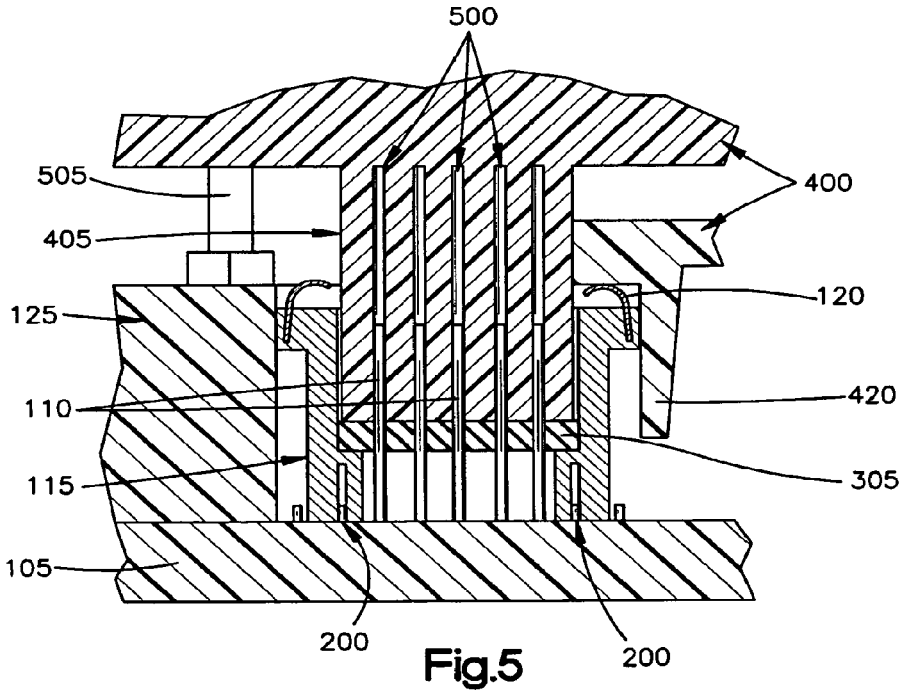
FIG. 5 illustrates a cross-section view of the example connector of FIG. 1 connected to the cable housing of FIG. 4.

With reference to FIG. 4, an example of a cable connector housing 400 is shown. The housing 400 includes an example cable connector 405 configured to mate with the example receptacle 115 shown in FIG. 1. A cross-section view of the receptacle 115 connected to the connector 405 is shown in FIG. 5. The housing 400 connects to a cable 410 that includes an outer cable shield. The housing 400 can be formed of an electrically conductive material that is in electrical contact with the cable shield. Signal lines (not shown) from the cable 410 are operably connected to signal contacts within the connector 405. The signal contacts, shown only as a plurality of openings in the connector 405, are configured to connect with one or more of the signal pins 110 from the component connector 100.

The cable housing 400 can also include a guide wall 420 adjacent to the connector 405. The guide wall 420 can assist in properly attaching the connector 405 to the receptacle 115. The guide wall 420 may also provide additional signal interference shielding. The cable housing 400 can also include a mounting portion 415 that is configured to cooperate with the mounting base 125 of the receptacle 115. A securing device like a screw can be threaded through the mounting portion 415 and connect to the mounting base 125 of the receptacle.

FIG. 5 illustrates an example cross-section view of the connector 405 inserted into the example receptacle 115 of FIG. 1 and connecting with the signal pins 110. In the example, the circuit board 105 is shown with the ground pins 200 and the signal pins 110 extending out from the circuit board 105. The ground pins 200 are configured with a shorter length than the signal pins 110 and are in electrical contact with the receptacle 115 as described previously. Of course, the ground pins 200 can have varying sizes relative to the signal pins 110 and may be longer if desired.

The signal pins 110 are shown as passing through the alignment matrix 305 and are in contact with one or more signal contacts 500 within the connector 405. The housing 400 of the cable connector is in electrical contact with the gasket 120 so that an electrical path is created from the circuit board 105 to the ground pins 200, to the receptacle 115, to the gasket 120, and to the cable housing 400. The housing 400 can be further secured by using a securing device 505 such as a screw that passes through the mounting portion 415 of the housing 400, through the mounting base 125 of the receptacle 115 and into the circuit board 105.

Figure 6:
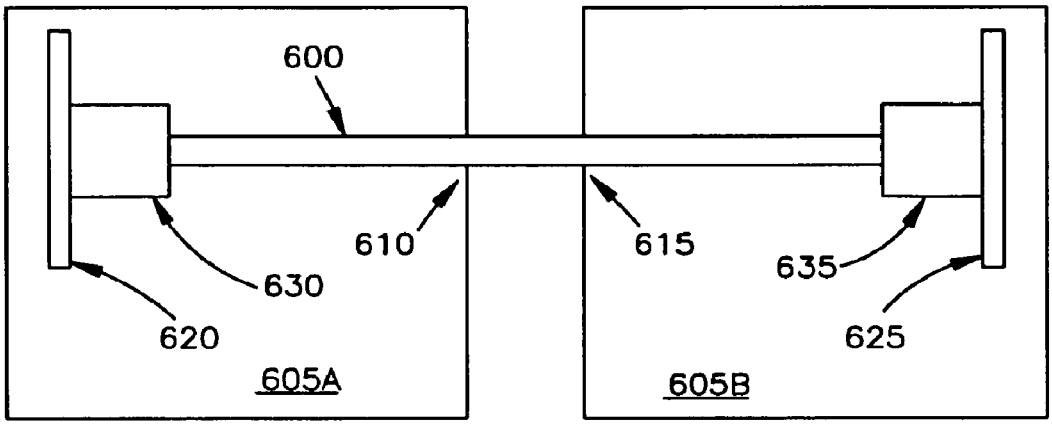
FIG. 6 illustrates an example diagram of two computer components connected together by a cable using an example connector described herein.

Illustrated in FIG. 6 is an example diagram of two computer components connected by a shielded signal cable 600. The computer components can include separate computers or other logic devices where one is contained in a chassis 605A and the other in a chassis 605B. Each chassis 605A, 605B can be an EMI shielded enclosure that includes an EMI pass-through point 610, 615 respectively. At each end of the cable 600, a cable connector is included that is configured to mate with a component connector to allow communication with a circuit board. For example, chassis 605A can include a circuit board 620 and chassis 605B can include circuit board 625 each having a component connector 630, 635 respectively. The component connectors 630 and 635 can be configured similarly to the component connector 100 shown in FIGS. 1-3.

Example methods may be better appreciated with reference to flow diagrams. While for purposes of simplicity of explanation, the illustrated methodologies are shown and described as a series of blocks, it is to be appreciated that the methodologies are not limited by the order of the blocks, as some blocks can occur in different orders and/or concurrently with other blocks from that shown and described. Moreover, less than all the illustrated blocks may be required to implement an example methodology. Blocks may be combined or separated into multiple components. Furthermore, additional and/or alternative methodologies can employ additional, not illustrated blocks. While the figures illustrate various actions occurring in serial, it is to be appreciated that various actions could occur concurrently, substantially in parallel, and/or at substantially different points in time.

Figure 7:
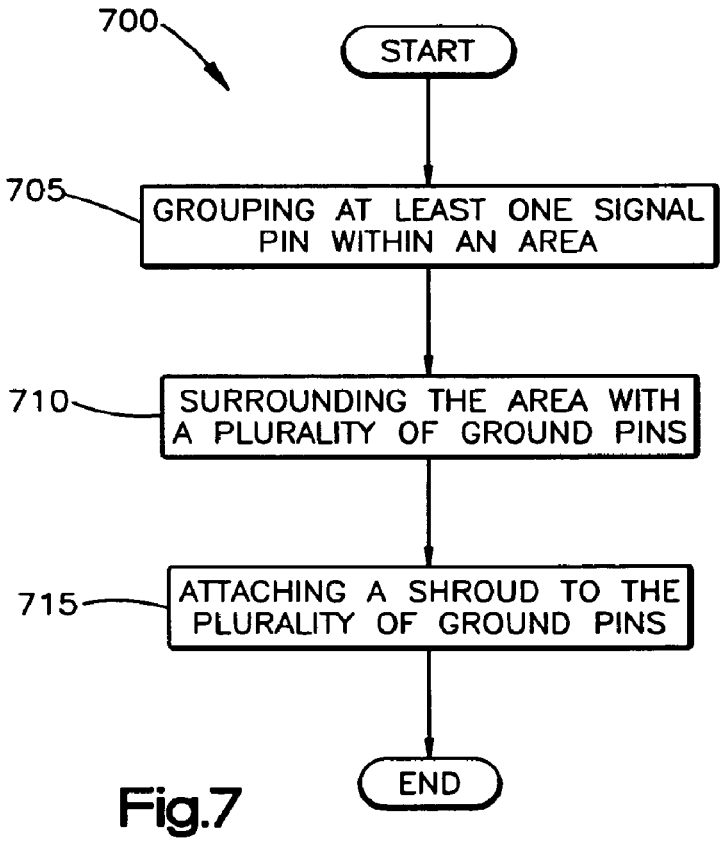
FIG. 7 illustrates an example methodology that can be associated with configuring an example component connector.

Illustrated in FIG. 7 is an example methodology that can be associated with configuring a connector and/or configuring a logic device to include a component connector. The illustrated elements denote "processing blocks" that may be implemented in logic. In one example, the processing blocks may represent executable instructions that cause a computer, processor, and/or logic device to respond, to perform an action(s), to change states, and/or to make decisions. Thus, the described methodologies can be implemented as processor executable instructions and/or operations provided by a computer-readable medium. In another example, the processing blocks may represent functions and/or actions performed by functionally equivalent circuits such as an analog circuit, a digital signal processor circuit, an application specific integrated circuit (ASIC), or other logic device. The diagram of FIG. 7, as well as the other illustrated diagrams, are not intended to limit the implementation of the described examples. Rather, the diagrams illustrate functional information one skilled in the art could use to design/fabricate circuits, generate software, or use a combination of hardware and software to perform the illustrated processing.

With reference to FIG. 7, the methodology 700 can be performed, for example, during the design of a circuit board or other logic device that includes the component connector and/or during manufacturing of the component connector. The methodology can begin by grouping at least one signal pin within an area (Block 705). The grouping of block 705 can include positioning the at least one signal pin on a circuit board, but as explained previously, it may be configured on other types of logic devices. The area can be surrounded with a plurality of ground pins (Block 710). A receptacle or shroud can then be attached to the plurality of ground pins in a manner as previously described (Block 715).

The methodology 700 can also include providing the receptacle/shroud that includes holes for receiving the plurality of ground pins. The holes can be configured to deform upon receiving a ground pin by force. In that regard, the ground pins can be provided that are formed of an electrically conductive material capable of deforming the holes of the receptacle. As previously explained, the receptacle can be formed of a material that is malleable or otherwise softer in relation to the material of the ground pins. It will also be appreciated that other acts and/or functions described in relation to figures other than FIG. 7 may be included and implemented as processor executable instructions.

In another example configuration of the component connector 100 shown in FIG. 1, the component connector 100 and the circuit board 105 may be configured with a reverse design of the ground pins 200. For example, the circuit board 105 may be configured with ground contacts that are disposed along the perimeter of the signal pins 110 where the ground contacts are a plurality of electrically conductive openings configured to receive ground pins. The ground pins, in this example, would be configured to extend out from the receptacle 115 and be inserted within the ground contacts of the circuit board. The ground contacts can be configured as openings that include electrically conductive sides that are deformable upon inserting a pin from the receptacle 115 in a similar manner as described in previous examples. In the example of FIG. 1, the ground contacts would represent the ground pins 200.

With the described example systems and methods, and their equivalents, a connector can be configured that provides an encompassing ground path around one or more signal pins that can be connected to a cable. Electromagnetic interference can be reduced with the signal return grounding provided by the example connectors described herein.

Figure 8:
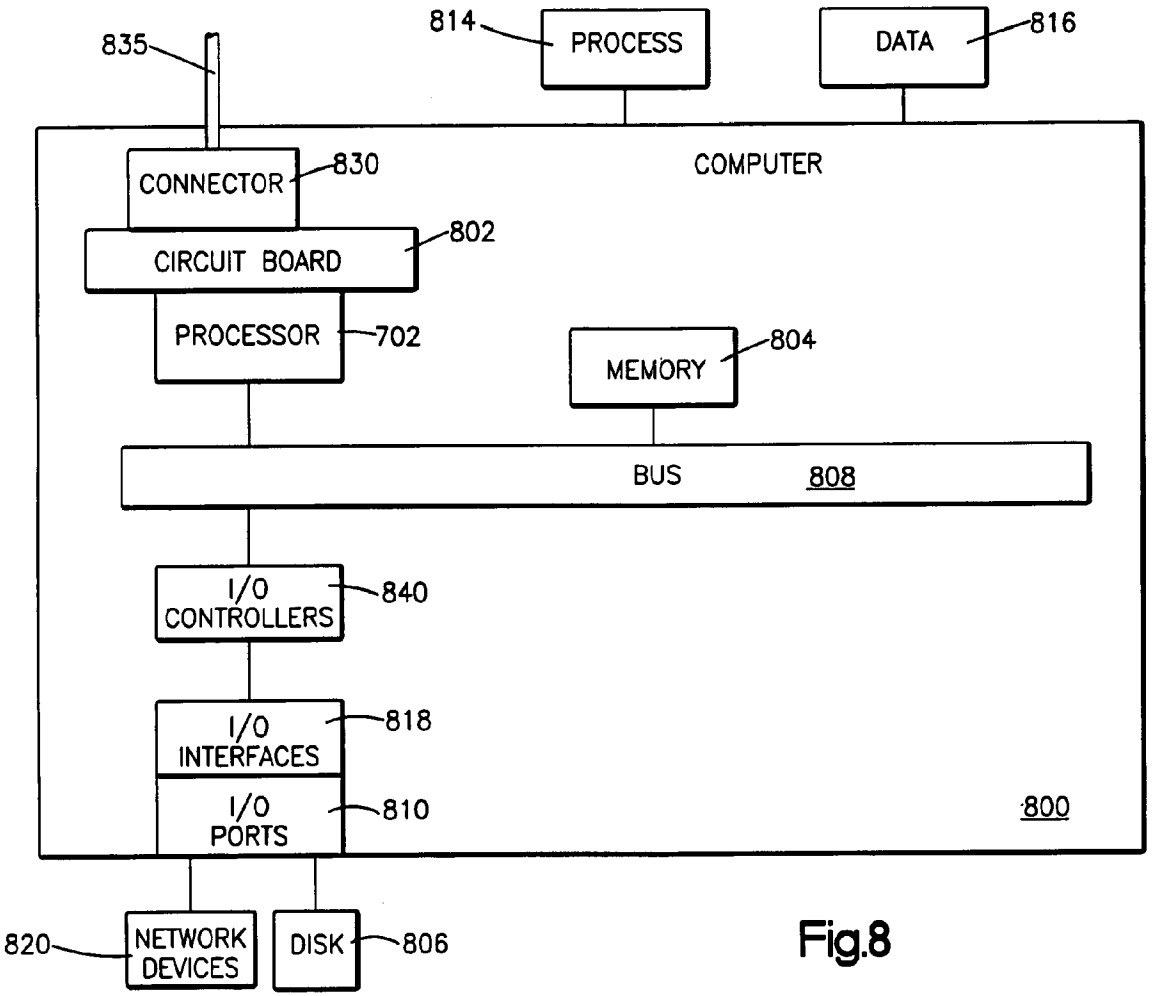
FIG. 8 illustrates an example computing environment in which example systems and methods illustrated herein can operate.

FIG. 8 illustrates an example computing device in which example systems and methods described herein, and equivalents, can operate. The example computing device may be a computer 800 that includes a processor 802, a memory 804, and input/output ports 810 operably connected by a bus 808. In one example, the computer 800 may include a component connector 830 configured to facilitate connection to a cable 835. The component connector 830 can be implemented similar to the component connector 100 described in previous figures, and/or the other systems and methods described herein.

Generally describing an example configuration of the computer 800, the processor 802 can be a variety of various processors including dual microprocessor and other multiprocessor architectures. The memory 804 can include volatile memory and/or non-volatile memory. The non-volatile memory can include, but is not limited to, ROM, PROM, EPROM, EEPROM, and the like. Volatile memory can include, for example, RAM, synchronous RAM (SRAM), dynamic RAM (DRAM), synchronous DRAM (SDRAM), double data rate SDRAM (DDR SDRAM), and direct RAM bus RAM (DRRAM).

A disk 806 may be operably connected to the computer 800 via, for example, an input/output interface (e.g., card, device) 818 and an input/output port 810. The disk 806 can include, but is not limited to, devices like a magnetic disk drive, a solid state disk drive, a floppy disk drive, a tape drive, a Zip drive, a flash memory card, and/or a memory stick. Furthermore, the disk 806 can include optical drives like a CD-ROM, a CD recordable drive (CD-R drive), a CD rewriteable drive (CD-RW drive), and/or a digital video ROM drive (DVD ROM). The memory 804 can store processes 814 and/or data 816, for example. The disk 806 and/or memory 804 can store an operating system that controls and allocates resources of the computer 800.

The bus 808 can be a single internal bus interconnect architecture and/or other bus or mesh architectures. While a single bus is illustrated, it is to be appreciated that computer 800 may communicate with various devices, logics, and peripherals using other busses that are not illustrated (e.g., PCIE, SATA, Infiniband, 1394, USB, Ethernet). The bus 808 can be of a variety of types including, but not limited to, a memory bus or memory controller, a peripheral bus or external bus, a crossbar switch, and/or a local bus. The local bus can be of varieties including, but not limited to, an industrial standard architecture (ISA) bus, a microchannel architecture (MSA) bus, an extended ISA (EISA) bus, a peripheral component interconnect (PCI) bus, a universal serial (USB) bus, and a small computer systems interface (SCSI) bus.

The computer 800 may interact with input/output devices via i/o interfaces 818 and input/output ports 810. Input/output devices can include, but are not limited to, a keyboard, a microphone, a pointing and selection device, cameras, video cards, displays, disk 806, network devices 820, and the like. The input/output ports 810 can include but are not limited to, serial ports, parallel ports, and USB ports.

The computer 800 can operate in a network environment and thus may be connected to network devices 820 via the i/o devices 818, and/or the i/o ports 810. Through the network devices 820, the computer 800 may interact with a network. Through the network, the computer 800 may be logically connected to remote computers. The networks with which the computer 800 may interact include, but are not limited to, a local area network (LAN), a wide area network (WAN), and other networks. The network devices 820 can connect to LAN technologies including, but not limited to, fiber distributed data interface (FDDI), copper distributed data interface (CDDI), Ethernet (IEEE 802.3), token ring (IEEE 802.5), wireless computer communication (IEEE 802.11), Bluetooth (IEEE 802.15.1), and the like. Similarly, the network devices 820 can connect to WAN technologies including, but not limited to, point to point links, circuit switching networks like integrated services digital networks (ISDN), packet switching networks, and digital subscriber lines (DSL).

While example systems, methods, and so on have been illustrated by describing examples, and while the examples have been described in considerable detail, it is not the intention of the applicants to restrict or in any way limit the scope of the appended claims to such detail. It is, of course, not possible to describe every conceivable combination of components or methodologies for purposes of describing the systems, methods, and so on described herein. Additional advantages and modifications will readily appear to those skilled in the art. Therefore, the invention is not limited to the specific details, the representative apparatus, and illustrative examples shown and described. Thus, this application is intended to embrace alterations, modifications, and variations that fall within the scope of the appended claims. Furthermore, the preceding description is not meant to limit the scope of the invention. Rather, the scope of the invention is to be determined by the appended claims and their equivalents.

To the extent that the term "includes" or "including" is employed in the detailed description or the claims, it is intended to be inclusive in a manner similar to the term "comprising" as that term is interpreted when employed as a transitional word in a claim. Furthermore, to the extent that the term "or" is employed in the detailed description or claims (e.g., A or B) it is intended to mean "A or B or both". When the applicants intend to indicate "only A or B but not both" then the term "only A or B but not both" will be employed. Thus, use of the term "or" herein is the inclusive, and not the exclusive use. See, Bryan A. Garner, A Dictionary of Modern Legal Usage 624 (2d. Ed. 1995).

What is claimed is:

1. A component connector, comprising:

at least one signal pin;

a plurality of ground pins positioned along a perimeter of the at least one signal pin to surround the at least one signal pin on all sides thereof; and a receptacle connected to and in electrical contact with the plurality of ground pins, the receptacle being configured with an opening to surround a mating cable connector housing for connecting at least one signal contact therein to the at least one signal pin.

2. The component connector of claim 1, the receptacle being configured with a plurality of holes for receiving the plurality of ground pins and configured to have the receptacle press fitted into contact with the plurality of ground pins.

3. The component connector of claim 2 where the plurality of holes include holes that are sized smaller than a size of a ground pin inserted therein.

4. The component connector of claim 1, the plurality of ground pins being formed from a first electrically conductive material and the receptacle being formed of a second electrically conductive material that is softer than the first electrically conductive material.

5. The component connector of claim 4 where the first electrically conductive material includes one or more of: tin and a tin alloy, and the second electrically conductive material includes one or more of: brass and a brass alloy.

6. The component connector of claim 1 where the plurality of ground pins include pins that are shorter in length than the at least one signal pin.

7. The component connector of claim 1 where the receptacle includes side walls that surround the at least one signal pin and define the opening, the side walls being formed of an electrically conductive material that is grounded by the plurality of ground pins and reduces electromagnetic interference.

8. The component connector of claim 1 where the component connector is mounted to a circuit board, and the at least one signal pin and the plurality of ground pins are electrically connected to the circuit board.

9. The component connector of claim 1, the receptacle including a plurality of compliant holes configured to deform upon receiving a ground pin with force.

10. The component connector of claim 1, the receptacle including a plurality of pin holes for receiving the plurality of ground pins, the plurality of pin holes being defined in the receptacle in an offset position relative to the plurality of ground pins.

11. The component connector of claim 1 further including a computing device connected to the connector where the connector provides for a cable connection to another computing device.

12. A computing device comprising:

a circuit board configured with one or more logic devices; and a connector positioned on the circuit board, the connector comprising:

at least one signal pin positioned in a connector area;

a group of ground pins connected to the circuit board and being distributed around all sides of the connector area to provide ground enclosure of the at least one signal pin; and a receptacle including openings for receiving the group of ground pins, the receptacle being formed of an electrically conductive material and being grounded by the group of ground pins, and the receptacle being configured with an opening to receive a mating cable connector housing including at least one signal contact for connecting to the at least one signal pin; and the electrically conductive material defining the openings and being deformable by insertion of a ground pin.

13. The computing device of claim 12 where the group of ground pins are formed of an electrically conductive material that is capable of deforming the electrically conductive material of the receptacle with pressure.

14. A system comprising:

means for connecting a cable to a circuit board comprising:

means for communicating signals between the cable and the circuit board;

means for providing ground contacts where the ground contacts are disposed along a perimeter of the means for communicating signals to surround the means for communicating signals; and means for enclosing the means for communicating signals and being connected to and in electrical contact with the plurality of ground contacts;

the means for enclosing creating an electrical enclosure around the means for communicating signals and being configured with an opening to surround a mating cable connector housing including contacts for electrically connecting with the means for communicating signals.

15. The system of claim 14, the means for providing ground contacts being configured as a plurality of openings in the circuit board that are electrically grounded, and the means for enclosing including a plurality of pins that are inserted into the plurality of openings to ground the means for enclosing.

16. The system of claim 15, where the plurality of openings include sides having deformable, electrically conductive material that deform upon inserting a pin from the means for enclosing.

17. The system of claim 14, the means for providing ground contacts being configured as a plurality of ground pins in the circuit board, and the means for enclosing including a plurality of openings for receiving the plurality of ground pins.

18. The system of claim 17, where the means for enclosing is formed of an electrically conductive material that deforms upon inserting the plurality of ground pins into the plurality of openings.

* * * * *